US005087271A

United States Patent [19]

Stellaccio et al.

[11] Patent Number: 5,087,271

[45] Date of Patent: Feb. 11, 1992

[54] PARTIAL OXIDATION PROCESS

[75] Inventors: Robert J. Stellaccio, Spring; Michael M. Dach, Houston, both of Tex.

[73] Assignee: Texaco Inc., White Plains, N.Y.

[21] Appl. No.: 615,551

[22] Filed: Nov. 19, 1990

[51] Int. Cl.[5] ..... C10J 3/46

[52] U.S. Cl. ..... 48/197 R; 48/198.1; 48/206; 48/212; 48/215; 48/DIG. 10; 252/373

[58] Field of Search ..... 48/197 R, 197 A, 200, 48/201, 202, 203, 206, 209, 212, 215, DIG. 10, 198.1; 252/373

[56] References Cited

U.S. PATENT DOCUMENTS

| | | | |
|---|---|---|---|
| 4,392,869 | 7/1983 | Marion et al. | 48/DIG. 10 |
| 4,394,137 | 7/1983 | Marion et al. | 48/197 R |
| 4,400,180 | 8/1983 | Marion et al. | 48/197 R |
| 4,474,581 | 10/1984 | Dille et al. | 48/DIG. 10 |
| 4,479,810 | 10/1984 | Marion et al. | 48/DIG. 10 |
| 4,490,156 | 12/1984 | Marion et al. | 48/61 |
| 4,676,805 | 6/1987 | Richter et al. | 48/197 R |
| 4,789,384 | 12/1988 | Martens et al. | 48/197 R |
| 4,888,031 | 12/1989 | Martens | 48/206 |
| 4,983,296 | 1/1991 | McMahon et al. | 48/197 A |

*Primary Examiner*—Peter Kratz

*Attorney, Agent, or Firm*—Robert A. Kulason; James J. O'Loughlin; Albert Brent

[57] ABSTRACT

This process pertains to a achieving high on-stream time and maintaining the temperature and composition of the raw effluent gas stream from a partial oxidation gas generator being fed simultaneously with a stream of gaseous fuel and separate stream of liquid hydrocarbonaceous fuel. Two parallel oxygen streams equipped with flow transmitters and control valves are used to supply the oxygen associated with two separate and different fuel streams. Each stream of oxygen is controlled by an $O_2$/fuel ratio control so that if the flow rate of either stream of fuel or its related oxygen stream changes, the oxygen/carbon atomic ratio of the remaining $O_2$ and fuel stream in the gasifier is maintained at a desired value. Further, if either fuel flow is stopped, its associated $O_2$ flow will stop, but the remaining fuel stream and its associated $O_2$ stream will continue to flow at the same rate with no change in the oxygen/fuel weight ratio. Complete shut down of the unit is thereby avoided. The quick raising of reactor temperatures to unsafe levels due to excess oxygen that occurs when one of the fuel streams is lost is thereby prevented.

38 Claims, 1 Drawing Sheet

PARTIAL OXIDATION PROCESS

BACKGROUND OF THE INVENTION

1. Field of the Invention

This invention relates to a process control system for the simultaneous feeding of two separate gaseous and/or liquid fuels into a partial oxidation synthesis gas generator.

2. Description of the Prior Art

The partial oxidation process for the production of synthesis gas e.g., gaseous mixtures comprising $H_2$ and CO is well known. Single fuel streams are most commonly used in the partial oxidation process, such as one stream of oil or one stream of fuel gas. The simultaneous introduction of a stream of fuel gas and a separate oil stream or two separate gaseous or liquid streams into a partial oxidation gasifier can be difficult due to two phase flow problems from mixing gas and liquid streams or due to two fuel streams, either gaseous or liquid, that are substantially different so as to require separate feed processing and handling. Feeding fuel gas and liquid hydrocarbonaceous fuel to a gas generator is discussed further in coassigned U.S. Pat. Nos. 4,394,137 and 4,443,230.

It is difficult to maintain high on-stream time for the simultaneous gasification of dual fuel feeds, e.g., oil and/or gas. This is especially true when the supply reliability of one fuel source is less than desirable. With the conventional oxygen control methods should one fuel flow be lost, excess oxygen can enter the gasifier and will produce undesirable high gasifier temperatures and poor product gas quality e.g., synthesis gas, reducing gas, or fuel gas.

SUMMARY OF THE INVENTION

This process pertains to a means of maintaining high on-stream time for the simultaneous feeding of multiple gaseous and/or liquid streams and combinations thereof. For example, two parallel oxygen streams equipped with flow transmitters and control valves are used to supply oxygen for the two separate and different fuel streams. Each stream of oxygen is separately controlled by an $O_2$/fuel ratio control so that if the flow rate of either stream of fuel changes the $O_2$/fuel ratio of the remaining $O_2$ and fuel streams in the gasifier is maintained at a desired value. Further, if either fuel flow is stopped, its associated $O_2$ flow will stop, but the remaining fuel stream and its associated $O_2$ flow will continue to flow at the same rate. Complete shutdown of the unit is thereby avoided. The O/C atomic ratio of each fuel is separately controlled. Any excess oxygen that could flow to the gasifier in the event one of the fuel streams is lost, thereby quickly raising the reactor temperature to unsafe levels, is prevented by the subject invention.

BRIEF DESCRIPTION OF THE DRAWING

In order to illustrate the invention in greater detail, reference is made to a preferred embodiment as shown in the figure of the drawing wherein FIG. I is a schematic representation of the invention showing control means for the simultaneous feeding of a stream of gaseous fuel and a separate stream of liquid hydrocarbonaceous fuel to a free-flow partial oxidation gas generator.

DESCRIPTION OF THE INVENTION

Figure 1:
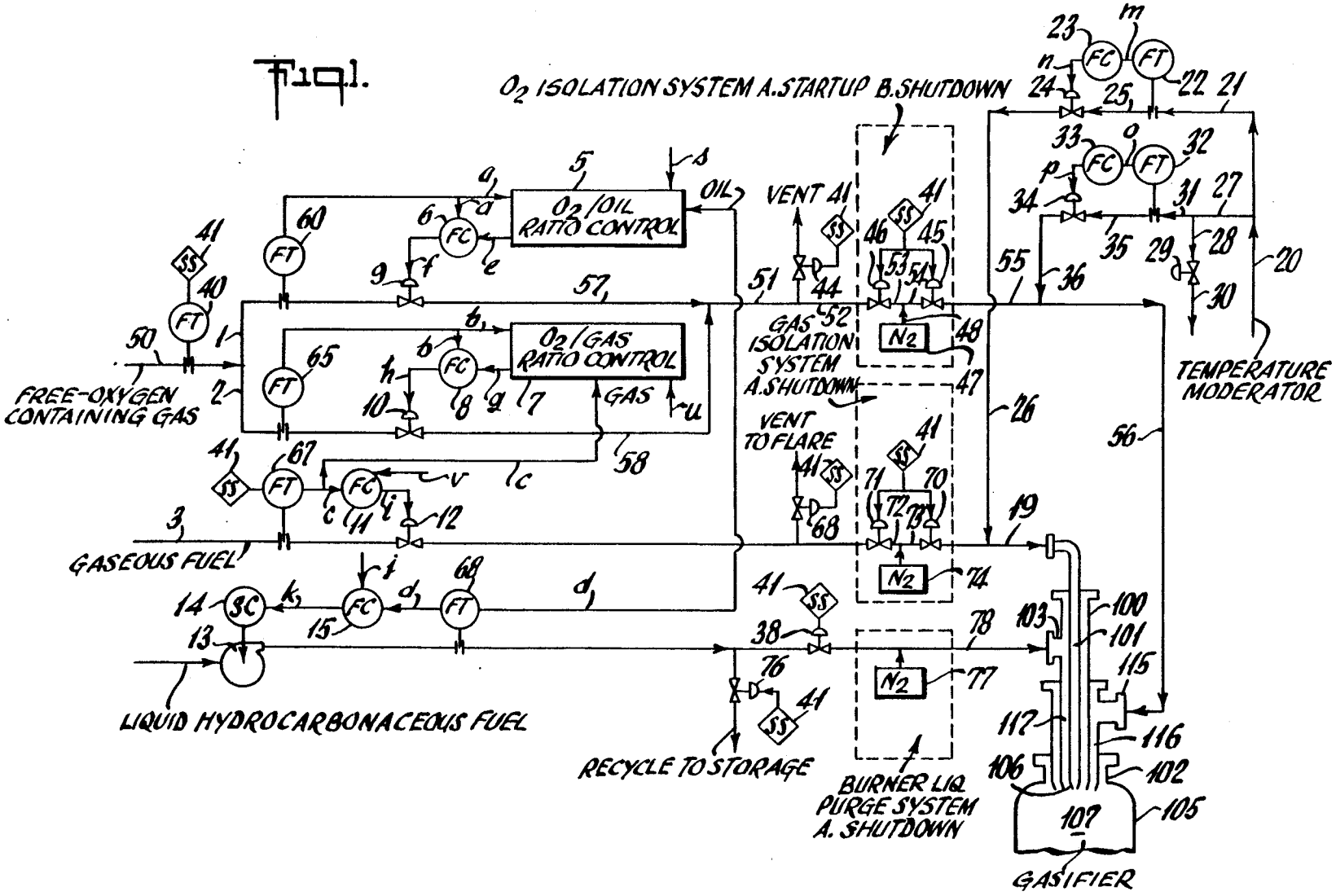

The present invention pertains to a continuous process for the manufacture of gas mixtures comprising $H_2$, CO, $CO_2$, particulate carbon and at least one material selected from the group consisting of $H_2O$, $N_2$, $A_r$, $CH_4$, $H_2S$, COS, and ash such as synthesis gas, fuel gas, and reducing gas, by the partial oxidation of a stream of gaseous fuel and a separate stream of liquid fuel in a conventional free-flow non-catalytic refractory lined partial oxidation gas generator.

The streams of gaseous fuel and liquid hydrocarbonaceous fuel are either mixed or separately introduced into the reaction zone of a conventional partial oxidation gas generator by way of a down-flowing burner which is inserted in the top of the gas generator. A separate stream of free-oxygen containing gas is also passed through the burner. The streams of fuel and free-oxygen-containing gas are mixed together at the burner tip. The partial oxidation reaction takes place downstream from the tip of the burner in the reaction zone of the partial oxidation gas generator at a temperature in the range of about 1800° F. to 3000° F., such as 2000° F.-2700° F., say 2400° F. -2600° F., and a pressure in the range of about 1 to 300 atmospheres. A temperature moderator may be mixed with the fuel streams and/or optionally with the free-oxygen containing gas upstream from the burner in order to maintain the reaction zone at the specified temperature.

The subject method for controlling the feed to a free-flow partial oxidation gas generator so as to maintain a high on-stream time, the desired operating temperature, and the composition of the raw effluent gas stream comprises the following steps as shown in the drawing:

(1) separately sensing each of the following feedstreams and providing separate signals corresponding to the flow rate for each of said feedstreams as follows: sensing the flow rate of the free-oxygen containing gas in line and providing signal a to $O_2$/first fuel ratio control 5 and to flow control 6, sensing the flow-rate of the free-oxygen containing gas in line 2 and providing signal b to $O_2$/second fuel ratio control 7 and to flow control 8, sensing the flow-rate of the second fuel in line 3 and providing signal c to $O_2$/second fuel ratio control 7 and to flow control 11, sensing the flow rate of the first fuel in line 4 and providing signal d to $O_2$/ first fuel ratio control 5 and to flow control means 15; sensing the flow-rate of the temperature moderator in line 21 and providing signal m to flow control 23, comparing signal m in flow control 23 with a preset signal representing the desired flow rate for the stream of temperature moderator in line 26 and providing an adjustment signal n to control valve 24 in line 25; and sensing the flow rate of the temperature moderator in line 31 and providing signal o to flow control 33, comparing signal o in flow control 33 with a preset signal representing the desired flow rate for the stream of temperature moderator in line 36 and providing an adjustment signal p to control valve 34 in line 35;

(2) dividing oxygen signal a by first fuel signal d in ratio control 5 to produce internal signal r representing the actual $O_2$/first fuel wt. ratio, comparing signal r in ratio control 5 with a preset signal s representing the desired $O_2$/first fuel wt. ratio, and producing an adjustment signal e for oxygen controller 6 which in turn produces an adjustment signal f for oxygen control valve 9 in line 1;

(3) dividing oxygen signal b by second fuel signal c in ratio control 7 to produce internal signal t representing the actual $O_2$/second fuel wt. ratio, comparing signal t in ratio control 7 with a preset signal u representing the desired $O_2$/second fuel wt. ratio, and producing an adjustment signal g for oxygen controller 8 which in turn produces an adjustment signal h for oxygen control valve 10 in line 2;

(4) combining together the free-oxygen gas streams passing through lines and 2, and passing the combined streams of free-oxygen containing gas through lines 51–56 and into the reaction zone of said gas generator;

(5) comparing second fuel signal c in flow control 11 with preset signal v representing the desired flow rate of the second fuel in line 3, and producing an adjustment signal i for second fuel control valve 12 in line 3, and passing the stream of second fuel into the reaction zone of said gas generator;

(6) comparing first fuel signal d in flow controller 15 with preset signal j representing the desired flow rate of first fuel in line 4, and producing an adjustment signal k for first fuel flow rate control means in line 4, and passing the stream of first fuel into the reaction zone of said gas generator; and (7) mixing the stream of temperature moderator from line 36 with the stream of free-oxygen containing gas from line 55, and introducing the mixture into the reaction zone of said generator, and/or mixing the stream of temperature moderator from line 26 with the stream of second fuel from line 19 and introducing the mixture into the reaction zone of said gas generator.

The term gaseous fuel or gaseous hydrocarbonaceous material as used herein to describe suitable gaseous fuels is intended to include a gaseous feedstock from the group consisting of natural gas, methane, ethane, propane, butane, pentane, hexane and dehydrogenated compounds thereof, off-gas from delayed coking, refinery off-gas, off-gas from catalytic cracking, fuel gas produced by the partial oxidation of carbon-containing fuels such as by the subject process, and mixtures thereof.

The term liquid fuel as used herein to describe suitable liquid carriers and fuels is intended to include various pumpable liquid hydrocarbon and/or liquid hydrocarbonaceous materials, such as those selected from the group consisting of liquefied petroleum gas, petroleum distillates and residues, gasoline, naphtha, kerosine, crude petroleum, gas oil, residual oil, tar sand oil, shale oil, coal derived oil, aromatic hydrocarbons (such as benzene, toluene, xylene fractions), coal tar, cycle gas oil from fluid-catalytic-cracking operation, furfural extract of coker gas oil, and mixtures thereof.

The term liquid hydrocarbonaceous material as used herein to describe suitable pumpable liquid fuels is also intended to include various oxygen-containing liquid hydrocarbonaceous organic materials, such as those selected from the group consisting of carbohydrates, cellulosic materials, aldehydes, organic acids, alcohols, ketones, oxygenated fuel, oil, waste liquids and by-products from chemical processes for producing oxygenated hydrocarbonaceous organic materials, and mixtures thereof.

The term liquid hydrocarbonaceous fuel as used herein to describe suitable liquid fuels is also intended to include pumpable slurries of solid carbonaceous fuels in a liquid carrier. In another embodiment, the liquid hydrocarbonaceous fuel comprises a pumpable mixture of coal-water slurry and sanitary sewage and said mixture has a solids content in the range of about 40 to 70 wt percent. In still another embodiment, the liquid hydrocarbonaceous fuel comprises a mixture of waste oil and dewatered sanitary sewage having a heating value of at least 6000 BTU per pound.

The term liquid carrier as used herein as the suspending medium to produce pumpable slurries of solid carbonaceous fuels is intended to include various materials from the group consisting of water, liquid hydrocarbonaceous material, and mixtures thereof. However, water is the preferred carrier for the particles of solid carbonaceous fuel. In one embodiment, the liquid carrier is liquid carbon dioxide. In such case, the liquid slurry may comprise 40–70 wt % of solid carbonaceous fuel and the remainder is liquid $CO_2$. The $CO_2$-solid fuel slurry may be introduced into the burner at a temperature in the range of about −67° F. to 100° F. depending on the pressure.

For example, one embodiment, the feedstream comprises a slurry of liquid hydrocarbonaceous material and solid carbonaceous fuel. $H_2O$ in liquid phase may be mixed with the liquid hydrocarbonaceous carrier, for example as an emulsion. A portion of the $H_2O$ i.e., about 0 to 25 weight % of the total amount of $H_2O$ present may be introduced as steam in admixture with the free-oxygen containing gas. The weight ratio of $H_2O$/fuel in the reaction zone may be in the range of about 0 to 5, say about 0.1 to 3.

The term solid carbonaceous fuels, as used herein to describe suitable solid carbonaceous feedstocks, is intended to include various materials and mixtures thereof from the group consisting of coal, coke from coal, char from coal, coal liquefaction residues, petroleum coke, particulate carbon soot, and solids derived from oil shale, tar sands, and pitch. All types of coal may be used including anthracite, bituminous, sub-bituminous, and lignite. The particulate carbon may be that which is obtained as a by-product of the subject partial oxidation process, or that which is obtained by burning fossil fuels. The term solid carbonaceous fuel also includes by definition bits of garbage, dewatered sanitary sewage sludge, semi-solid organic materials such as asphalt, rubber, and rubber-like materials including rubber automobile tires which may be ground or pulverized to the proper particle size. Any suitable grinding system may be used to convert the solid carbonaceous fuels or mixtures thereof to the proper size. The solid carbonaceous fuels are preferably ground to a particle size so that 100% of the material passes through an ASTM E 11-70 Sieve Designation Standard 1.4 mm (Alternative No. 14) and at least 80% passes through an ASTM E 11-70 Sieve Designation Standard 425 um (Alternative No. 40). The moisture content of the solid carbonaceous fuel particles is in the range of about 0 to 40 wt. % such as 2 to 20 wt. %.

$H_2O$ in liquid or gaseous phase, is preferably introduced into the reaction zone to help control the reaction temperature, to act as a dispersant of the hydrocarbonaceous fuel fed to the reaction zone, to entrain or slurry the solid carbonaceous fuel, and to serve as a reactant to increase the relative amount of hydrogen produced. Other suitable temperature moderators include $CO_2$-rich gas, a cooled portion of effluent gas from the gas generator, cooled off-gas from an integrated ore-reduction zone, nitrogen, and mixtures thereof. The temperature moderator is introduced into the gas generator to maintain the temperature of the reaction zone in the range of about 1800° F. to 3000° F. The temperature moderator may be introduced into the gasifier in admixture with the free-oxygen containing gas stream and/or the stream of gaseous fuel and/or the stream of liquid fuel.

The free-oxygen containing gas may be selected from the group consisting of air, oxygen-enriched air (22 mole percent $O_2$ and preferably substantially pure oxygen (95 mole percent $O_2$ and higher). The amount of nitrogen in the product gas may be substantially reduced or eliminated by using substantially pure oxygen. In the reaction zone, the ratio of the atoms of free-oxygen to atoms of carbon in the gaseous and/or liquid hydrocarbonaceous feed is in the range of about 0.85 to 1.5. Alternatively, this ratio may be expressed as about 0.85 to 1.5 atoms of oxygen per atom of carbon.

Conventional burners for use with the partial oxidation gasifier are suitable for the subject process. For example, reference is made to the two, three and four stream annular-type burners in coassigned U.S. Pat. Nos. 3,874,592, 3,847,564 and 4,525,175 respectively, which are incorporated herein by reference.

In one embodiment, the gaseous and/or liquid fuels optionally in admixture with the temperature moderator, are introduced into the synthesis gas generator by way of the same or separate conduits of a conventional annular-type synthesis gas burner. The free-oxygen containing gas, optionally in admixture with the temperature moderator is introduced into the gas generator by way of a separate passage in said burner.

For example, the gaseous fuel, optionally in admixture with the temperature moderator, is introduced into the gas generator by way of the central conduit of a three stream annular-type synthesis gas burner comprising a central conduit and inner and outer coaxial concentric annular free-flow passages, such as shown and described in coassigned U.S. Pat. No. 3,847,564. The liquid hydrocarbonaceous fuel is introduced into said gas generator by way of the inner annular passage in said burner. The free-oxygen containing gas, optionally in admixture with the temperature moderator, is introduced into the gas generator by way of the outer annular passage of said burner.

In another embodiment, the gaseous and liquid fuels are mixed together and introduced into said gas generator by way of one passage of an annular-type synthesis gas burner comprising a central conduit and a coaxial concentric annular passage, such as shown and described in coassigned U.S. Pat. No. 3,874,592. Simultaneously, a combined stream of temperature moderator and free-oxygen containing gas is passed into said gas generator by way of the other passage of said burner. In still another embodiment, the liquid hydrocarbonaceous fuel comprises an aqueous slurry of sanitary sewage sludge and a separate stream of oil and/or coal. Said aqueous slurry of sanitary sewage sludge is introduced into the reaction zone by way of one passage in a multipassage annular-type synthesis gas burner while said stream of oil and/or coal is introduced into said gas generator by way of another passage of said burner. In a further embodiment, the liquid hydrocarbonaceous fuel comprises a pumpable mixture of coal-water slurry and sanitary sewage, and said mixture has a solids content in the range of about 40 to 70 weight percent. The liquid hydrocarbonaceous fuel may also comprise a mixture of waste oil and coal.

In one further embodiment, the gaseous fuel is introduced into the partial oxidation gas generator by way of the central passage of an annular-type synthesis gas burner comprising a central passage and a coaxial concentric annular passage. Simultaneously, a combined stream of free-oxygen containing gas and temperature moderator is introduced into said gas generator by way of said annular passage. By means of a 4-stream annular-type burner, such as described in coassigned U.S. Pat. No. 4,525,175, two separate streams of free-oxygen containing gas, optionally in admixture with a temperature moderator e.g. $H_2O$, may be passed respectively through the central and outer passages of said burner. Further, two separate fuel streams selected from the groups consisting of gaseous fuel, liquid hydrocarbonaceous fuel, and mixtures thereof may be simultaneously passed through the two separate annular passages in said burner located between the central and outer oxygen streams.

DESCRIPTION OF THE DRAWING

A more complete understanding of the invention may be had by reference to the accompanying schematic drawing which shows the subject invention in detail. Although the drawing illustrates a preferred embodiment of the invention, it is not intended to limit the subject invention to the particular apparatus or materials described.

Referring to the drawing, FIG. I is a schematic representation of one embodiment of the invention showing control means for the continuous operation of a synthesis gas generator while maintaining the desired composition of the product gas by adjustments to the flow rates of one or more of the reactant streams. Thus, by the subject flow control system, the flow rates for all of the reactant streams are separately and independently controlled so that the free-oxygen to fuel weight ratios in the reaction zone are maintained at design conditions and within desired operating ranges for the fuels being reacted.

While the control system shown in FIG. I is specifically designed for the combination of feedstocks comprising a gaseous fuel and a liquid hydrocarbonaceous fuel, by simple modifications to the means for changing the flow rates of the fuel streams as described below, the system may be used to control other combinations of solid carbonaceous fuel slurries, liquid hydrocarbonaceous fuels, and gaseous fuels.

In FIG. I, burner 100 is mounted in central flanged inlet 102, which is located in the upper head of conventional refractory lined free-flow synthesis gas generator 105 along the central longitudinal axis. The reactant streams enter through the upstream end of burner 100, pass downward therethrough, and are discharged through downstream end 106. Burner 100 is designed so that the required system output for steady-state operation may be achieved or even exceeded by a specified amount when the flow rate through all passages is a maximum. The control system can independently change the flow rate of any one or more of the feedstreams in lines 1 to 4, 26 and 56. By this means (1) the weight ratio of free-oxygen to fuel in the reaction zone is maintained at desired conditions, (2) the composition of the product gas remains substantially unchanged, and (3) the temperature in the reaction zone 107 is maintained at the desired operating temperature.

Operation of the process and control system shown in FIG. I follows. For purposes of illustration, the principal fuels may be for example a pumpable liquid hydrocarbonaceous fuel e.g., petroleum oil from line 4, and a gaseous fuel e.g. natural gas in line 3. Of course, the principal fuels may be any gaseous fuels, liquid hydrocarbon or liquid hydrocarbonaceous fuels, and combinations thereof, as previously described.

The free-oxygen containing gas in line 50 is split into a first stream which passes through line 1 and a second stream which passes through line 2. The two streams of free-oxygen containing gas are then combined in line 51. The combined free-oxygen containing gas stream is introduced into gas generator 105 by way of lines 51 to 56 and burner 100.

The flow rate of free-oxygen containing gas in line 1 is measured and signal a is provided to free $O_2$/liquid hydrocarbonaceous fuel ratio control 5 by flow transmitter 60. Signal a corresponds to the actual flow rate of the free-oxygen containing gas in line 1. A liquid hydrocarbonaceous fuel feed e.g. oil is pumped through line 4 by means of a conventional positive displacement metering pump 13 equipped with speed control 14. The actual flow rate of the liquid hydrocarbonaceous fuel in line 4 is measured and signal d is provided by flow transmitter 68. Signals a and d are simultaneously introduced into free-oxygen/liquid fuel ratio control 5. Signal a is divided by signal d in ratio control 5, thereby providing internal signal r. Signal d is simultaneously introduced into flow recorder-controller 15 where it is compared with a preset signal j representing the desired or theoretical flow rate for the liquid hydrocarbonaceous fuel. Adjustment signal k is provided to increase or decrease speed control means 14 by a specific amount so that the liquid hydrocarbonaceous fuel in line 4 assumes the desired flow rate. For example, liquid hydrocarbonaceous fuel may be pumped through line 4 by variable - speed pump 13. In an embodiment wherein a gaseous fuel is passed through line 4, pump 13 may be replaced by a gas compressor.

Ratio controller 5 includes a microcomputer means which receives and divides signals a and d to produce internal signal r representing the actual free $O_2$/fuel weight ratio (basis liquid hydrocarbonaceous fuel). Signal r is then compared with a signal s representing the theoretical or set point $O_2$/fuel weight ratio. A corresponding adjustment signal e is then provided to flow comptroller 6 which in turn provides signal f to open or close valve 9 a specific amount so that the free-oxygen containing gas in line 1 assumes the desired flow rate for the setpoint $O_2$/oil wt. ratio (basis liquid hydrocarbonaceous fuel). The new free-oxygen containing gas rate is measured and the cycle is repeated. By this means, repeated adjustments to the rate of oxygen flow are made and the free-oxygen containing gas flowing in line 1 is phased into line 51 in an amount that will maintain the required $O_2$/ oil weight ratio (basis liquid hydrocarbonaceous fuel) in the reaction zone.

When the rate of oil flow in line 4 changes, then the actual $O_2$/oil wt. ratio (basis liquid hydrocarbonaceous fuel) changes in an inverse manner and a corresponding signal r is produced. As previously described, adjustment signal e is produced and sent to flow controller 6 which in turn provides signal f to close or open valve 9 in oxygen-containing gas line 1 a sufficient amount so that the O/C atomic ratio (basis liquid hydrocarbonaceous fuel) in gasifier 100 remains substantially constant. For example, when the rate of oil e.g. gallons per hour through line 4 decreases, the free $O_2$/oil wt. ratio increases. An adjustment signal is sent to close valve 9 a specified amount so that the desired Oz/oil wt. ratio (basis liquid hydrocarbonaceous fuel is maintained. If the flow of oil in line 4 stops, then oxygen control valve 9 is completely closed to shut off the supply of oxygen from line which is associated with the supply of liquid hydrocarbonaceous fuel from line 4.

Similarly, with respect to the gaseous fuel feed from a compressor (not shown) in line 3, the flow rate of free-oxygen containing gas in line 2 is simultaneously measured and a signal b is provided to $O_2$/gas ratio control 7 by flow transmitter 65. Signal b corresponds to the actual flow rate of the free-oxygen containing gas in line 2. In addition to signal b, signal c provided by flow transmitter 67 upon measuring the flow rate of the gaseous fuel feed e.g., natural gas in line 3 is introduced into $O_2$/gas ratio control 7. Signal b is divided by signal c in ratio control 7 to provide internal signal t. Ratio controller 7 includes a microcomputer means which receives and divides signals b and c to produce internal signal t representing the actual free $O_2$/gas wt. ratio (basis gaseous fuel). Signal t is then compared in ratio control 7 with signal u representing the theoretical or setpoint $O_2$/gas weight ratio. A corresponding adjustment signal g is then provided to flow recorder-controller 8 which in turn provides signal h to open or close valve 10 a specific amount, so that the free-oxygen containing gas in line 2 assumes the desired flow rate for the desired free $O_2$/gas wt. ratio. The new free-oxygen containing gas rate is measured and the cycle is repeated. By this means repeated adjustments to the rate of oxygen flow are made and the free-oxygen containing gas flowing in line 2 is phased into line 51 in an amount that will maintain the actual O/C atomic ratio (basis gaseous fuel) in the reaction zone at design conditions.

In the embodiment wherein the gaseous fuel in line 3 is replaced by a liquid hydrocarbonaceous fuel, than a variable-speed pumping means, such as described previously e.g., 13 and 14 may be used to introduce the fuel in line 3 into the gas generator.

In one embodiment, a portion of a temperature moderator, for example steam in line 36 is mixed with the free-oxygen gas in line 55 and passed through inlet 115 and outer annular passage 116 of burner 100. Optionally, steam in line 26 may be mixed with the gaseous fuel in line 19 and simultaneously passed through central conduit 101 of burner 100. Simultaneously, the stream of liquid hydrocarbonaceous fuel is passed through intermediate annular passage 117 of burner 100.

Control of the temperature moderator is effected by sensing the flow rate of the temperature moderator in line 21 and providing signal m to flow controller 23 by means of flow transmitter 22, comparing signal m in flow control 23 with a preset signal representing the desired flow rate for the stream of temperature moderator in line 26, and providing an adjustment signal n to control valve 24 in line 25 to open or close valve 24 a specific amount so that the temperature moderator in line 26 assumes the desired flow rate for the desired temperature in the reaction zone and $H_2O$/fuel wt. ratio. Similarly, the flow rate of the temperature moderator in line 31 is sensed by flow transmitter 32, and signal o is provided to flow controller 33. Signal o is compared in flow controller 33 with a preset signal representing the desired flow rate for the stream of temperature moderator in line 36, and adjustment signal p is provided to control valve 34 in line 35 to open or close valve 34 a specific amount so that the temperature moderator in line 36 assumes the desired flow rate for the desired temperature in the reaction zone and $H_2O$/fuel wt ratio. For example, if the temperature moderator is $H_2O$, from about 0 to 20 wt. % of the $H_2O$, e.g. 20 wt. % may be mixed with the gaseous fuel in line 19 and the remainder of the $H_2O$, such as about 20 to 100 wt. % e.g. 80 wt. % may be mixed with the free-oxygen containing gas in line 56.

The preset setpoint signals in $O_2$/oil ratio control 5, $O_2$/gas ratio control 7, and in the flow controls are determined by conventional calculations based on heat and weight balances for the entire system.

In one embodiment, the oxygen line is provided with an isolation system which uses a high pressure nitrogen barrier to prevent undesirable oxygen flows and undesirable reactor gas flows during the sequential gasifier startup procedure, during a planned manual gasifier shutdown, and during an emergency automatic gasifier shutdown. In FIG. 1, the oxygen line is provided with an isolation safety system which will become active and shutoff all of the oxygen flow in the process when the oxygen flow rate in the main line to the system is lost or falls below a preset shutdown flow value. Thus, the rate of flow of the oxygen feed in main line 50 is determined by flow transmitter 40. A signal representing the rate of oxygen flow in line 50 is sent to a safety signal means Safety System (SS) 41. When the rate of oxygen flow is to low, signals are provided by the safety system 41 to close oxygen flow valves 9 and 10, close oxygen block valves 45 and 46, and activate high pressure nitrogen barrier 47. By this means undesirable oxygen forward flow into the gasifier or vent, and undesirable reactor gas reverse flow into the oxygen lines or vent are prevented. Optionally in FIG. 1, during a manual and/or automatic gasifier shutdown, safety circuit 41 keeps oxygen vent valve 44 closed, closes oxygen flow valves 9 and 10, closes oxygen block valve 46, and activates a high pressure nitrogen purge which passes nitrogen through lines 48, 54, 55 and 56 for 30 to 60 seconds to prevent combustion in burner oxygen passage 116. After which, oxygen block valve 45 is closed to prevent undesirable oxygen and reactor gas flows.

In still another embodiment, the gaseous fuel line is provided with the isolation system which uses a high pressure nitrogen barrier to prevent undesirable reactor gas back flows during intended operation without gaseous fuel, during a planned manual gasifier shutdown, and during an emergency automatic gasifier shutdown.

Accordingly, to assure safe operation in the event the gaseous fuel flow is lost or falls below a preset value, a nitrogen pocket is used to prevent back flow to the fuel line that was lost. For example, if the gaseous fuel stream in line 3 is intentionally stopped or unintentionally lost or falls below a preset value, a signal from gas flow transmitter 67 representing the actual flowrate for the gaseous fuel is compared in said signal means 41 with a preset signal representing the desired gaseous fuel flowrate, and responsive thereto signals are provided for the closing of valves 70 and 71 and the filling of lines 72–73 connecting said valves with nitrogen 74. The associated $O_2$ flow will stop but the unit will not shutdown since the gasifier is provided with fuel from the other fuel feedstream e.g., liquid hydrocarbonaceous fuel from line 4.

If the flow of liquid hydrocarbonaceous fuel in line 4 is stopped, a signal from safety system 41 will result in stopping pump 13, closing valve 14 and keeping valve 76 closed to avoid depressuring any oil in the line to storage. Nitrogen 77 may be passed through line 78, inlet 103 of burner 100, and intermediate annular passage 117 to purge the burner and the lines from residual oil and thereby prevent coking.

Although modifications and variations of the invention may be made without departing from the spirit and scope thereof, only such limitations should be imposed as are indicated in the appended claims.

We claim:

1. A process for controlling the feed to the reaction zone of a free-flow partial oxidation gas generator comprising the steps of:

(1) sensing the flow rate of a first stream of free-oxygen containing gas and providing a corresponding signal a to a first ratio control means and to a first flow control means, sensing the flow rate of a second stream of free-oxygen containing gas and providing a corresponding signal b to a second ratio control means and to a second flow control means, wherein said first and second streams of free-oxygen containing gas are supplied with free-oxygen containing gas from a main oxygen feed-line, sensing the flow-rate of a stream of gaseous fuel and providing a corresponding signal c to said second ratio control means and to a third flow control means, sensing the flow rate of a stream of liquid hydrocarbonaceous fuel and providing a corresponding signal d to said first ratio control means and to a fourth flow control means, sensing the flow-rate of a first stream of temperature moderator and providing a corresponding signal m to a fifth flow control means, comparing signal m in said fifth flow control means with a preset signal representing the desired flow rate for said first stream of temperature moderator and providing an adjustment signal n to a flow control means for said first stream of temperature moderator, sensing the flow rate of a second stream of temperature moderator and providing a corresponding signal o to a sixth flow control means, comparing signal o in said sixth flow control means with a preset signal representing the desired flow rate for said second stream of temperature moderator and providing an adjustment signal p to a flow control means for said second stream of temperature moderator;

(2) dividing said oxygen signal a by said liquid fuel signal d in said first ratio control means to produce a signal corresponding to the actual $O_2$/liquid hydrocarbonaceous fuel weight ratio and comparing said signal in said first ratio control means with a preset signal representing the desired $O_2$/liquid hydrocarbonaceous fuel weight ratio and providing a corresponding adjustment signal e to said first flow control means from which adjustment signal f is provided to a first oxygen control valve which controls the rate of flow of said first stream of free-oxygen containing gas from (1);

(3) dividing said oxygen signal b by said gaseous fuel signal c in said second ratio control means to produce signal t corresponding to the actual $O_2$/gaseous fuel weight ratio, comparing said signal t in said second ratio control means with a preset signal representing the desired $O_2$/gaseous fuel weight ratio, and providing a corresponding adjustment signal g to said second flow control means from which adjustment signal h is provided to a second oxygen control valve which controls the rate of flow of said second stream of free-oxygen containing gas from (1);

(4) combining together said first and second streams of free-oxygen gas streams leaving steps 2 and 3;

(5) comparing said signal c corresponding to the flow rate of the gaseous fuel in said third flow control means with a preset signal v representing the desired flow rate for the gaseous fuel, and producing a corresponding adjustment signal i for a gas control valve which controls the rate of flow of said stream of gaseous fuel into the reaction zone of said gas generator;

(6) comparing said signal d corresponding to the flow rate of the liquid hydrocarbonaceous fuel in said fourth flow control means with a preset signal j representing the desired flow rate for the liquid hydrocarbonaceous fuel, and producing a corresponding adjustment signal k for a speed control means of a liquid fuel pump, and passing the stream of liquid hydrocarbonaceous fuel into the reaction zone of said gas generator; and (7) mixing said second stream of temperature moderator from step 1 with the combined stream of free-oxygen containing gas from step 4 and introducing the mixture into the reaction zone of said partial oxidation gas generator.

2. The process of claim 1 wherein said gaseous fuel is selected from the group consisting of natural gas, methane, ethane, propane, butane, pentane, hexane, and dehydrogenated compounds thereof, off-gas from delayed coking, refinery off-gas, off-gas from catalytic cracking, fuel gas produced by the partial oxidation of carbon-containing fuels, and mixtures thereof.

3. The process of claim 1 wherein said liquid hydrocarbonaceous fuel is selected from the group consisting of liquefied petroleum gas, petroleum distillates and residues, gasoline, naphtha, kerosine, crude petroleum, gas oil, residual oil, tar sand oil, shale oil, coal derived oil, aromatic hydrocarbons, coal tar, cycle gas oil from fluid-catalytic-cracking operation, furfural extract of coker gas oil, and mixtures thereof.

4. The process of claim 1 wherein said fuel is selected from the group of liquid hydrocarbonaceous materials consisting of carbohydrates, cellulosic materials, aldehydes, organic acids, alcohols, ketones, oxygenated fuel oil, waste liquids and by-products from chemical processes for producing oxygenated hydrocarbonaceous organic materials, and mixtures thereof.

5. The process of claim 1 wherein said liquid hydrocarbonaceous fuel is a pumpable slurry of solid carbonaceous fuel in a liquid carrier.

6. The process of claim 5 wherein said liquid carrier is selected from the group consisting of water, liquid hydrocarbonaceous carbonaceous material, and mixtures thereof.

7. The process of claim 5 wherein said solid carbonaceous fuel is selected from the group consisting of coal, coke from coal, char from coal, coal liquefaction residues, petroleum coke, particulate carbon soot, solids derived from oil shale, tar sands, pitch and mixtures thereof.

8. The process of claim 7 wherein said coal is selected from anthracite, bituminous, sub-bituminous, lignite, and mixtures thereof.

9. The process of claim 7 wherein said particulate carbon soot is a by-product of the subject partial oxidation process, or that which is obtained by burning fossil fuels.

10. The process of claim 5 wherein said solid carbonaceous fuel is selected from the group consisting of bits of garbage, dewatered sanitary sewage sludge, semi-solid organic materials, asphalt, rubber materials, automobile tires and mixtures thereof.

11. The process of claim 1 wherein said temperature moderator is selected from the group consisting of $H_2O$ in liquid or gaseous phase, $CO_2$-rich gas, a cooled portion of effluent gas from the gas generator, cooled off-gas, nitrogen, and mixtures thereof.

12. The process of claim 1 wherein said free-oxygen containing gas is selected from the group consisting of air, oxygen-enriched air comprising 122 mole % $O_2$ and higher, and substantially pure oxygen comprising 95 mole % $O_2$ and higher.

13. The process of claim 1 wherein in said partial oxidation gas generator the ratio of the atoms of free-oxygen to atoms of carbon in the gaseous and/or liquid hydrocarbonaceous feed is in the range of about 0.85 to 1.5.

14. The process of claim 1 wherein said gaseous fuel in step 5 in admixture with said temperature moderator is introduced into said gas generator by way of a conduit in a synthesis gas burner, and wherein said liquid hydrocarbonaceous fuel in step 6 is introduced into said gas generator by way of said burner, and wherein said free-oxygen containing gas in step 4 in admixture with said temperature moderator is introduced into said gas generator by way of at least one separate passage in said burner.

15. The process of claim 1 wherein said gaseous fuel in step 5 in admixture with said temperature moderator is introduced into said gas generator by way of the central conduit of a three stream synthesis gas burner comprising a central conduit and inner and outer coaxial concentric annular free-flow passages, and wherein said liquid hydrocarbonaceous fuel in step 6 is introduced into said gas generator by way of said inner annular passage in said burner, and wherein said free-oxygen containing gas in step 4 in admixture with said temperature moderator is introduced into said gas generator by way of said outer annular passage.

16. The process of claim 1 provided with the steps of mixing together said stream of gaseous fuel from step 5 and said stream of liquid hydrocarbonaceous fuel from step 6, and introducing the resulting mixture into said partial oxidation gas generator.

17. The process of claim 16 wherein said mixture is introduced into said gas generator by way of one passage of a synthesis gas burner comprising a central conduit and a coaxial concentric annular passage, and wherein simultaneously said combined stream of temperature moderator and free-oxygen containing gas from step 7, is passed into said gas generator by way of the other passage of said burner.

18. The process of claim 1 wherein said liquid hydrocarbonaceous fuel in step 6 comprises an aqueous slurry of sanitary sewage sludge and a separate stream of oil and/or coal, and said aqueous slurry of sanitary sewage sludge is introduced into said reaction zone by way of one passage in a multi-passage synthesis gas burner while said stream of oil and/or coal is introduced into said gas generator by way of another passage of said burner.

19. The process of claim 1 wherein said liquid hydrocarbonaceous fuel in step 6 comprises a pumpable mixture of coal-water slurry and sanitary sewage, and said mixture has a solids content in the range of about 40 to 70 weight percent.

20. The process of claim 1 wherein said liquid hydrocarbonaceous fuel in step 6 comprises a mixture of waste oil and coal.

21. The process of claim 1 wherein said gaseous fuel from step 5 is introduced into said partial oxidation gas generator by way of the central passage of a synthesis gas burner comprising a central passage and a coaxial concentric annular passage, and wherein simultaneously said combined stream of free-oxygen containing gas and temperature moderator is introduced into said gas generator by way of said annular passage.

22. The process of claim 1 provided with the safety feature for shutting off all of the flow of gaseous fuel when the gaseous fuel flow rate falls below a preset value, or is lost comprising the steps of sensing the flow rate of the gaseous fuel in the main gas fuel line and providing a signal representing the actual flow rate for the gaseous fuel to a safety signal means, and a comparing said signal in said safety signal means with a preset signal representing the desired gaseous fuel flow rate, b providing a signal to close two fuel gas block valves in the line when the flow rate for the gaseous fuel falls below the desired flow rate, and c introducing nitrogen into the line connecting said two block valves.

23. The process of claim 1 wherein the first stream of temperature moderator from step 1 is mixed with the stream of gaseous fuel from step 5 and said mixture is then introduced in the reaction zone of said partial oxidation gas generator.

24. The process of claim 1 provided with the safety feature for shutting off all of the oxygen flow in the system during a gasifier shutdown or when the flow rate of the free-oxygen containing gas in the main oxygen feed line to the system falls below a preset shutdown flow rate value comprising the steps of: sensing the flow rate of the free-oxygen containing as in the main oxygen feed line to the system and providing a signal corresponding to the actual oxygen flow rate to a safety signal means provided with means for comparing said signal with a preset signal representing the desired oxygen flow rate, and responsive thereto providing signals for a closing an oxygen vent valve for said combined streams of free-oxygen containing gas, b closing said first and second oxygen control valves, and closing a first oxygen block valve; and introducing nitrogen into the lines downstream from said first closed oxygen block valve and through the lines carrying said combined stream of free-oxygen containing gas to said gas generator; and then closing a second oxygen block valve downstream from said first oxygen block valve to prevent undesirable oxygen and reactor gas flows.

25. A process for controlling the feed to the reaction zone of a free-flow partial oxidation gas generator comprising the steps of:

(1) sensing the flow rate of a first stream of free-oxygen containing gas and providing a corresponding signal a to a first ratio control means and to a first flow control means, sensing the flow rate of a second stream of free-oxygen containing gas and providing a corresponding signal b to a second ratio control means and to a second flow control means, wherein said first and second streams of free-oxygen containing gas are supplied with free-oxygen containing gas from a main oxygen feed-line, sensing the flow-rate of a stream of gaseous fuel and providing a corresponding signal c to said second ratio control means and to a third flow control means; sensing the flow rate of a stream of liquid hydrocarbonaceous fuel and providing a corresponding signal d to said first ratio control means and to a fourth flow control means;

(2) dividing said oxygen signal a by said liquid fuel signal d in said first ratio control means to produce a signal corresponding to the actual $O_2$/liquid hydrocarbonaceous fuel weight ratio and comparing said signal in said first ratio control means with a preset signal representing the desired $O_2$/liquid hydrocarbonaceous fuel weight ratio and providing a corresponding adjustment signal e to said first flow control means from which adjustment signal f is provided to a first oxygen control valve which controls the rate of flow of said first stream of free-oxygen containing gas from (1);

(3) dividing said oxygen signal b by said gaseous fuel signal c in said second ratio control means to produce signal t corresponding to the actual $O_2$/gaseous fuel weight ratio, comparing said signal t in said second ratio control means with a preset signal representing the desired $O_2$/gaseous fuel weight ratio, and providing a corresponding adjustment signal g to said second flow control means from which adjustment signal h is provided to a second oxygen control valve which controls the rate of flow of said second stream of free-oxygen containing gas from (1);

(4) combining together said first and second streams of free-oxygen gas streams leaving steps 2 and 3 and introducing the combined stream into the reaction zone of a partial oxidation gas generator by way of a burner;

(5) comparing said signal c corresponding to the flow rate of the gaseous fuel in said third flow control means with a preset signal v representing the desired flow rate for the gaseous fuel, and producing a corresponding adjustment signal i for a gas control valve which controls the rate of flow of said stream of gaseous fuel into the reaction zone of said gas generator; and (6) comparing said signal d corresponding to the flow rate of the liquid hydrocarbonaceous fuel in said fourth flow control means with a preset signal j representing the desired flow rate for the liquid hydrocarbonaceous fuel, and producing a corresponding adjustment signal k for a speed control means of a liquid fuel pump, and passing the stream of liquid hydrocarbonaceous fuel into the reaction zone of said partial oxidation gas generator.

26. The process of claim 25 wherein said gaseous fuel is selected from the group consisting of natural gas, methane, ethane, propane, butane, pentane, hexane and dehydrogenated compounds thereof, off-gas from delayed coking, refinery off-gas, off-gas from catalytic cracking, fuel gas produced by the partial oxidation of carbon-containing fuels, and mixtures thereof.

27. The process of claim 25 wherein said liquid hydrocarbonaceous fuel is selected from the group consisting of liquefied petroleum gas, petroleum distillates and residues, gasoline, naphtha, kerosine, crude petroleum, gas oil, residual oil, tar sand oil, shale oil, coal derived oil, aromatic hydrocarbons, coal tar, cycle gas oil from fluid-catalytic-cracking operation, furfural extract of coker gas oil and mixtures thereof.

28. The process of claim 25 wherein said fuel is selected from the group of liquid hydrocarbonaceous materials consisting of carbohydrates, cellulosic materials, aldehydes, organic acids, alcohols, ketones, oxygenated fuel oil, waste liquids and by-products from chemical processes for producing oxygenated hydrocarbonaceous organic materials, and mixtures thereof.

29. The process of claim 25 wherein said liquid hydrocarbonaceous fuel is a pumpable slurry of solid carbonaceous fuel in a liquid carrier.

30. The process of claim 29 wherein said liquid carrier is selected from the group consisting of water, liquid hydrocarbonaceous material, and mixtures thereof.

31. The process of claim 29 wherein said solid carbonaceous fuel is selected from the group consisting of coal, coke from coal, char from coal, coal liquefaction residues, petroleum coke, particulate carbon soot, and mixtures thereof.

32. The process of claim 31 wherein said coal is selected from anthracite, bituminous, sub-bituminous, and lignite.

33. The process of claim 25 wherein said free oxygen containing gas is selected from the group consisting of air, oxygen-enriched air comprising 22 mole percent $O_2$ and higher, and preferably substantially pure oxygen comprising 95 mole percent $O_2$ and higher.

34. The process of claim 25 wherein said gaseous fuel in step 5 is introduced into said gas generator by way of the central conduit of a three stream a synthesis gas burner comprising a central conduit and inner and outer coaxial concentric annular free-flow passages, and wherein said liquid hydrocarbonaceous fuel in step 6 is introduced into said gas generator by way of said inner annular passage in said burner, and wherein said free-oxygen containing gas in step 4 is introduced into said gas generator by way of said outer annular passage.

35. The process of claim 25 provided with the step of introducing a temperature moderator into said gas generator to maintain the temperature of the reaction zone in the range of about 1800° F. to 3000° F., and wherein said temperature moderator is introduced in admixture with the free-oxygen containing gas stream from (4) and/or the stream of gaseous fuel from (5) and/or the stream of liquid fuel from (6).

36. The process of claim 35 wherein said temperature moderator is selected from the group consisting of $H_2O$ in gaseous or liquid phase, $CO_2$-rich gas, cooled effluent gas from the gas generator, cooled off-gas, nitrogen, and mixtures thereof.

37. A process for controlling the feed of first and second fuel streams and first and second streams of free-oxygen containing gas to the reaction zone of a free-flow partial oxidation gas generator comprising the following steps:

(1) sensing the flow rate of said first stream of free-oxygen containing gas stream and providing signal a to an $O_2$/first fuel ratio control means and to a first oxygen control means, sensing the flow-rate of said second free-oxygen containing gas stream and providing signal b to an $O_2$/second fuel ratio control means and to a second flow control means, wherein said first and second streams of free-oxygen containing gas are supplied with free-oxygen containing gas from a main oxygen feedline to the system, and are subsequently combined and introduced into a gasifier burner; sensing the flow-rate of said second stream of fuel nd providing signal c to said $O_2$/second fuel ratio control and to said second flow control means, sensing the flow rate of said first stream of fuel and providing signal d to said $O_2$/first fuel ratio control and to a third flow control means; sensing the flow-rate of a first stream of temperature moderator and providing signal m to a fifth flow control means, comparing signal m in said fifth flow control means with a preset signal representing the desired flow rate for said first stream of temperature moderator and providing an adjustment signal n to a flow control valve for said first stream of temperature moderator, sensing the flow-rate of a second stream of temperature moderator and providing signal o to a sixth flow control means, comparing signal o in said sixth flow control means with a preset signal representing the desired flow-rate for said second stream of temperature moderator in line 36 and providing an adjustment signal p to a flow control valve for said second stream of temperature moderator;

(2) dividing said oxygen signal a by said first fuel signal d in said $O_2$/first fuel ratio control means to produce a signal corresponding to the actual $O_2$/first fuel wt. ratio and comparing said signal in said $O_2$/first fuel ratio control means with a preset signal representing the desired $O_2$/first fuel wt. ratio and providing an adjustment signal e to said first oxygen flow control means from which adjustment signal f is provided to an oxygen control valve which controls the rate of flow of said first stream of free-oxygen containing gas from (1);

(3) dividing said oxygen signal b by said second fuel signal c in said $O_2$/second fuel ratio control means to produce signal t corresponding to the actual $O_2$/second fuel wt. ratio, comparing said signal t in said $O_2$/second fuel ratio control means with a preset signal representing the desired $O_2$/second fuel wt. ratio and providing an adjustment signal g to said second flow control means from which adjustment signal h is provided to a second oxygen control valve which controls the rate of flow of said second stream of free-oxygen containing gas from (1);

(4) introducing said first and second streams of free-oxygen containing gas into the reaction zone of said gas generator;

(5) comparing said second fuel flow-rate signal c in said second flow control means with preset signal v representing the desired flow rate of said second fuel, and producing an adjustment signal i for second fuel flow rate control valve means, and passing the stream of second fuel into the reaction zone of said gas generator;

(6) comparing said first fuel flow-rate signal d in said third flow control means with preset signal j representing the desired flow rate of the first fuel, and producing an adjustment signal k for first fuel flow rate control means, and passing the stream of first fuel into the reaction zone of said gas generator; and (7) a mixing together the second stream of temperature moderator from step 1 with the first and second streams of free-oxygen containing gas from steps 2 and 3 and/or b mixing together the first stream of temperature moderator from step 1 with the stream of second fuel from step 5, and introducing mixture a and/or mixture b into the reaction zone of the partial oxidation gas generator.

38. The process of claim 37 wherein said first and second streams of free-oxygen containing gas from steps 2 and 3 with or without admixture with a temperature moderator, are respectively introduced into the reaction zone of said partial oxidation gas generator by way of the central and outer passages of a four passage burner; and said second and first fuel streams from steps 5 and 6 respectively are selected from the group consisting of gaseous fuel, liquid hydrocarbonaceous fuel, and mixtures thereof and are simultaneously passed into the reaction zone of said synthesis gas generator by way of two separate annular passages of said burner located between said central and outer oxygen streams.

* * * * *